US007204266B2

(12) United States Patent
Krenzer et al.

(10) Patent No.: US 7,204,266 B2
(45) Date of Patent: Apr. 17, 2007

(54) PILOT-OPERATED PRESSURE SHUT-OFF VALVE

(75) Inventors: Günter Krenzer, Karlstadt (DE); Karl Josef Meyer, Rieneck (DE); Peter Lauer, Lohr am Main (DE)

(73) Assignee: Bosch Rexroth AG, Lohr/Main (DE)

( * ) Notice: Subject to any disclaimer, the term of this patent is extended or adjusted under 35 U.S.C. 154(b) by 0 days.

(21) Appl. No.: 10/399,671

(22) PCT Filed: Oct. 19, 2001

(86) PCT No.: PCT/EP01/12094

§ 371 (c)(1),
(2), (4) Date: Apr. 18, 2003

(87) PCT Pub. No.: WO02/36967

PCT Pub. Date: May 10, 2002

(65) Prior Publication Data

US 2004/0099828 A1 May 27, 2004

(30) Foreign Application Priority Data

Nov. 4, 2000 (DE) ..... 100 54 704

(51) Int. Cl.
*F16K 17/00* (2006.01)

(52) U.S. Cl. ..... 137/115.19; 137/115.21; 137/115.23; 137/491; 137/492.5

(58) Field of Classification Search ..... 137/115.19, 137/115.21, 115.23, 491, 492.5
See application file for complete search history.

(56) References Cited

U.S. PATENT DOCUMENTS 3,024,732 A 3/1962 Nyman
3,273,581 A * 9/1966 McAfee ..... 137/115.19
3,621,881 A * 11/1971 Vicari ..... 137/625.66
4,114,637 A * 9/1978 Johnson ..... 137/115.21
6,135,142 A * 10/2000 Yokota et al. ..... 137/486

FOREIGN PATENT DOCUMENTS

CH 670873 7/1989
DE 1043819 11/1958

(Continued)

OTHER PUBLICATIONS

Specification sheet RD 26 411/03.98, Mannesmann Rexroth Jan. 12-Apr. 12, Rexroth Hydraulics.

*Primary Examiner*—Stephen M. Hepperle
(74) *Attorney, Agent, or Firm*—Martin A. Farber

(57) ABSTRACT

A pilot-operated pressure shut-off valve having a main control piston which, when an upper system limit pressure in the hydraulic system is reached, connects an inlet, via which pressure medium can be fed to a hydraulic system, to an outlet by taking up a first switching position and, when a lower system limit pressure is reached, separates from the outlet by taking up a second switching position. The pressure shut-off valve has a pilot valve arrangement by which the fluidic connection of a control space adjacent to the main control piston can be changed in order to control the main control piston, and which has a valve housing, with a first pilot piston and a second pilot piston accommodated within the first pilot piston for compact construction and capability to adjust the two pilot pistons mechanically completely independently of each other.

16 Claims, 3 Drawing Sheets

FOREIGN PATENT DOCUMENTS

| | | |
|---|---|---|
| DE | 3401369 | 8/1984 |
| DE | 3401360 | 8/1985 |
| DE | 3608100 | 9/1987 |
| DE | 4112065 | 10/1992 |
| GB | 1207085 | 9/1970 |

* cited by examiner

PILOT-OPERATED PRESSURE SHUT-OFF VALVE

FIELD AND BACKGROUND OF THE INVENTION

The invention relates to a pilot-operated pressure shut-off valve which, when an upper system limit pressure is reached in a hydraulic system having a hydraulic accumulator, connects an inlet feeding the hydraulic system to an outlet to a tank and separates this connection when removal of hydraulic fluid from the hydraulic accumulator has caused the system pressure to drop to a lower system limit pressure and which has a main control piston and, in order to control the main control piston, a pilot valve arrangement having two pilot pistons and two pilot springs, the adjustment of which makes it possible for the upper system limit pressure and the lower system limit pressure to be set independently of each other.

A pilot-operated pressure shut-off valve of this type is disclosed, for example, in DE 41 12 065 A1 or in DE 36 08 100 C2. In the case of the pressure shut-off valve according to DE 41 12 065 A1, the pilot valve arrangement comprises two complete pilot valves having a respective valve housing, having a pilot piston in a bore of the valve housing and having a pilot spring which is situated in a spring space and the prestress of which can be changed with the aid of a setting screw. The two pilot valves are placed one above the other onto the housing of the main stage. This pressure shut-off valve has a fairly large construction and is relatively expensive.

In the case of the pressure shut-off valve according to DE 36 08 100 C2, the pilot valve arrangement only has one valve housing. In the latter, two valve bores, each of which accommodates one of the two pilot pistons, run at a distance from and parallel to each other. The two pilot springs are accommodated next to each other in an extension of the valve bores in a cover fitted onto the valve housing of the pilot valve arrangement. The pilot valve arrangement in this pressure shut-off valve still has a fairly complex construction.

There are also pilot-operated pressure shut-off valves in which the pilot valve arrangement has just one pilot piston and one pilot spring and an adjustment of the one system limit pressure always also involves an adjustment of the other system unit pressure. The difference between the two limit pressures is a percentage of the upper system limit pressure, this percentage depending on the size of a surface difference on the pilot piston and on the prestress of the pilot spring. A pilot-operated pressure shut-off valve of this type, in which the upper system limit pressure and the lower system limit pressure cannot be set independently of each other, is disclosed, for example, in the applicant's specification sheet RD 26 411/03.98.

SUMMARY OF THE INVENTION

The invention is based on the object of developing a pilot-operated pressure shut-off valve having the introductory-mentioned features in such a manner that the pilot valve arrangement is constructed compactly and simply, can be produced cost-effectively and can be interchanged for a pilot valve arrangement of a pressure shut-off valve, in which the upper system limit pressure and the lower system limit pressure cannot be set independently of each other.

The objective which is sought is achieved according to the invention wherein, the two pilot pistons, the two pilot springs and the two setting screws are arranged lying concentrically inside one another, with it being possible to adjust the two pilot pistons mechanically completely independently of each other. In this manner, the pilot valve arrangement is constructed very compactly with a low height. Only one valve housing is needed for the pilot valve arrangement. Instead of a conventional pilot valve arrangement which does not permit any independent setting of the two limit pressures from each other, said pilot valve arrangement can easily be constructed on a main stage. In comparison with a pilot valve arrangement having two valve bores for the two pilot pistons, the machining of the valve housing of a pilot valve arrangement according to the invention is substantially simplified, since only one valve bore is needed for the two pilot pistons. The compact, concentric arrangement of the pilot pistons, the pilot springs and the setting screws also makes possible a cartridge-type construction which it has hitherto not been possible to realize.

The complete mechanical independence of the two pilot pistons in respect of their movement possibilities can thus be achieved in a simple manner wherein the outer pilot piston is situated with an outer collar between two stops fixed on the housing, wherein the one stop is formed on a bushing inserted into the valve housing, and wherein the inner pilot piston penetrates the bushing and is situated with an outer collar between the bushing and a further insert placed in the valve housing.

In order for the first pilot piston to be reliably switched over when the upper system limit pressure is reached and to remain in the one switching position until the system pressure drops to the lower system limit pressure, wherein said pilot piston is a stepped piston along with other features of the invention. A pressure space is formed upstream of the stepped surface with pump pressure being produced in it with the main stage closed and which is relieved of pressure by or for switching over the first pilot piston when the upper system limit pressure is reached. The first pilot piston is acted upon on the stepped surface by the pressure prevailing in the pressure space in the same direction as by the first pilot spring. The first pilot piston is acted upon on a large, first active surface by the system pressure counter to the direction of action of the first pilot spring. The minimal, lower system limit pressure is determined, with an established, upper system limit pressure, by the surface difference between the first active surface, on which the system pressure produces a force, and the second active surface, on which the pump pressure produces a force. According to another feature of the invention the stepped surface of the first pilot piston or, more generally, the active surface on the first pilot piston, at which the pump pressure produces a force directed in the same direction as the spring force, is at least one third of the size of the large active surface, at which the system pressure produces a counterforce. The first pilot piston already reliably switches over at such a ratio of sizes. Preferably, according to another feature of the invention the stepped surface is approximately two thirds of the size of the large active surface. In principle, the stepped surface can also be made even larger in comparison with the large active surface. However, this no longer lies within the sense of a compact construction. In addition, a ratio of sizes of two thirds is sufficient in order also to make possible the greatest desired difference between the upper system limit pressure and the lower system limit pressure.

According to yet other features of the invention the second pilot piston is formed as a stepped piston and is acted upon by pump pressure on the stepped surface in the direction of action of the second pilot spring while it is acted upon on a large, first active surface by the system pressure counter to the direction of action of the second pilot spring. This ensures that the second pilot piston, over the entire pressure and quantity range of the pressure shut-off valve, passes reliably into the switching position determined by the second pilot spring. According to another feature of the invention the size of the stepped surface of the second pilot piston preferably lies in the region of 5% of the large active surface on the end of the second pilot piston.

The objective sought by the invention can be achieved irrespective of which of the two pilot pistons is the outer pilot piston which accommodates the other pilot piston in it. However, with regard to a compact construction, it has proven particularly favorable if, according to another feature of the invention the first pilot piston is the hollow piston in which the second pilot piston is guided.

It is particularly advantageous for controlling the main control piston if, according to another feature of the invention the two pilot pistons of the pilot valve arrangement can be used to control two throughflow cross sections which are arranged in series between the control space of the main control piston and a tank connection. For controlling the throughflow cross sections, the pilot pistons are acted upon, according to other features of the invention by the different pressures and by the pilot springs. It should be pointed out here that the construction according to these features affords advantages over previously known pilot connections even with a detached construction of the pilot valve arrangement, i.e. even if the two pilot pistons are not arranged one inside the other or if there are even two separate pilot valves. However, the control arrangement according to these features is particularly favorable if the two pilot pistons are arranged lying one inside the other, since then, according to features of the invention the relieving of the control space on the main control piston, i.e. the opening of the two throughflow cross sections lying in series, is possible with little structural outlay. If the first pilot piston is the outer pilot piston, then in the case of a construction according to further features of the invention the fluid path across the two throughflow cross sections is formed in a particularly simple manner.

The reliability of switching over to the inlet connection with the system is also increased by a construction according to still other features of the invention. This is because the second pilot piston covers a greater distance in the closing direction owing to the further aperture in the first pilot piston. If then, owing to the rise in pressure in the outer annular space, the first pilot piston moves more rapidly than the second pilot piston in the closing direction, its first apertures are already covered on the outside by the control edge fixed on the housing in the event that said apertures are opened once again on the inside. The small clearance between the pilot pistons and between the first pilot piston and the housing is used in a specific manner for a small leakage flow from the further aperture into the relief space, the leakage flow also being able to include the first apertures and constituting part of the entire leakage flow. Due to the additional leakage flow which is caused by the further aperture and is to be reduced in order to raise the system pressure, the second pilot piston covers the greater distance. In particular, it has turned out that, owing to the further aperture, the opening cross section between the first apertures and the control edge fixed on the housing no longer has to have such precise tolerances, and the pressure shut-off valve nevertheless reliably switches.

Finally, according to still other features of the invention the invention is also already implemented solely by the pilot valve arrangement having the corresponding features from the introductory-mentioned paragraph and having other features of the invention.

BRIEF DESCRIPTION OF THE DRAWINGS

Two exemplary embodiments of a pilot-operated pressure shut-off valve according to the invention are illustrated in the drawings. The invention will now be explained in greater detail with reference to the figures of these drawings, in which.

DETAILED DESCRIPTION OF THE PREFERRED EMBODIMENT

Figure 2:
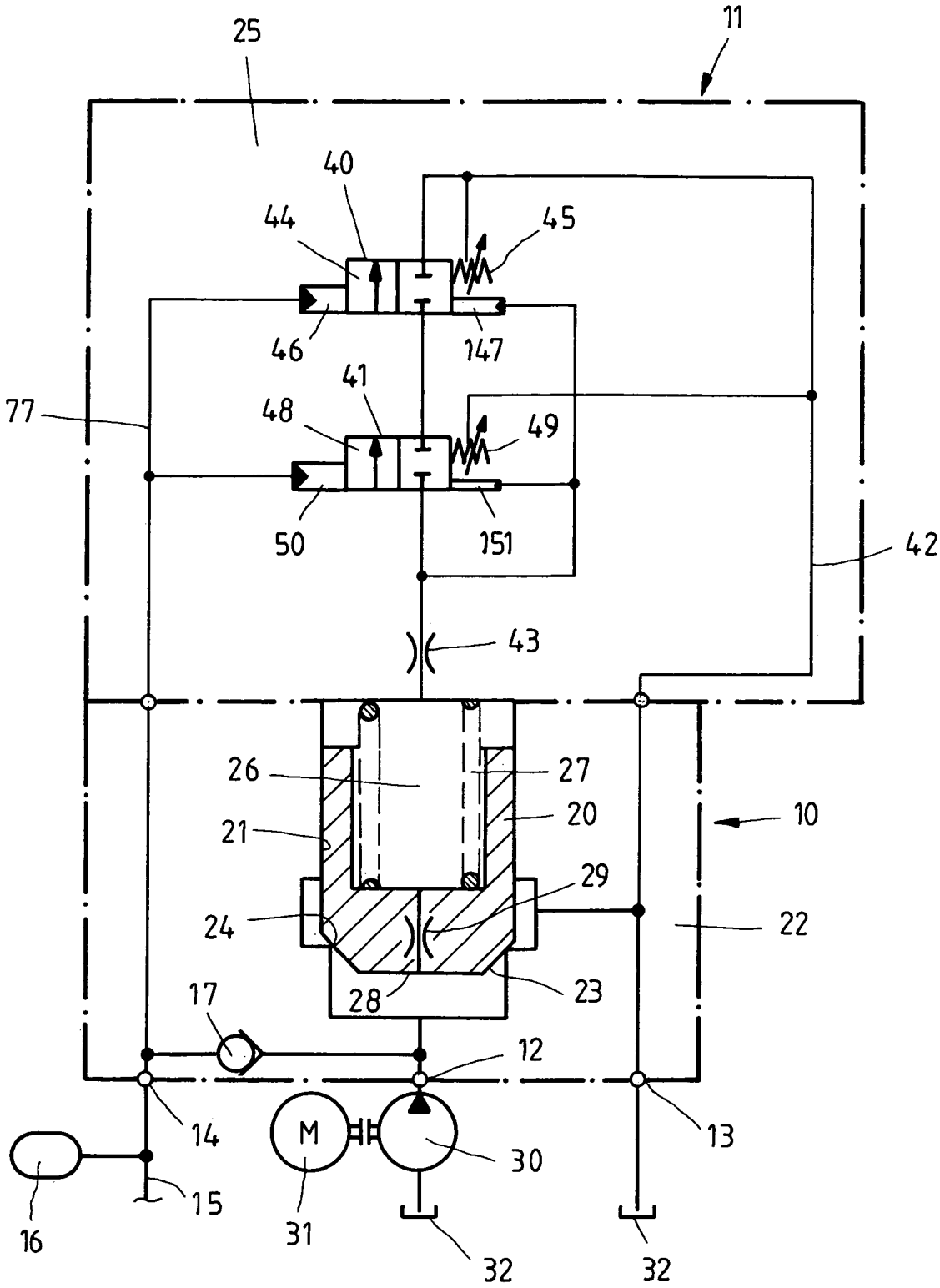
FIG. 2 shows a connection diagram of the exemplary embodiments shown.

According to the connection diagram of FIG. 2, the pilot-operated pressure shut-off valve which is shown comprises a main stage 10 and a pilot valve arrangement 11, which are respectively indicated by a dash-dotted rectangle. The main stage 10 has an inlet connection 12, an outlet connection 13 and a system connection 14. Leading off from the latter is a system line 15 to which a hydraulic accumulator 16 and directional control valves (not illustrated specifically) for controlling hydraulic consumers are connected. The inlet connection 12 and the system connection 14 are connected to each other via a nonreturn valve 17 which opens from the inlet connection toward the system connection. The main stage 10 includes a main control piston 20 with which a throughflow cross section between the inlet connection 12 and the outlet connection 13 can be opened and closed. The main control piston is guided on a first diameter in a bore 21 in the housing 22 of the main stage and is able to sit with a frustoconical surface 23 on a seat edge 24, the diameter of which is slightly smaller than the guiding diameter. The bore 21 is closed on the one side by the valve housing 25 of the pilot valve arrangement 11, which valve housing is placed onto the valve housing 22. A control space 26 is formed in the bore between this valve housing 25 and the main control piston 20 and is used to accommodate a weak helical compression spring 27 which is supported on the housing 25 and the main control piston 20 and loads the latter in the direction of the seat edge 24. That end surface 28 of the main control piston 20 which lies within the seat edge 24 delimits a space which is open toward the inlet connection 12. This space is fluidically connected to the control space 26 via a nozzle 29 formed in the main control piston 20.

A hydraulic pump 30 which is driven by an electric motor 31 is connected to the inlet connection 12.

Figure 1:
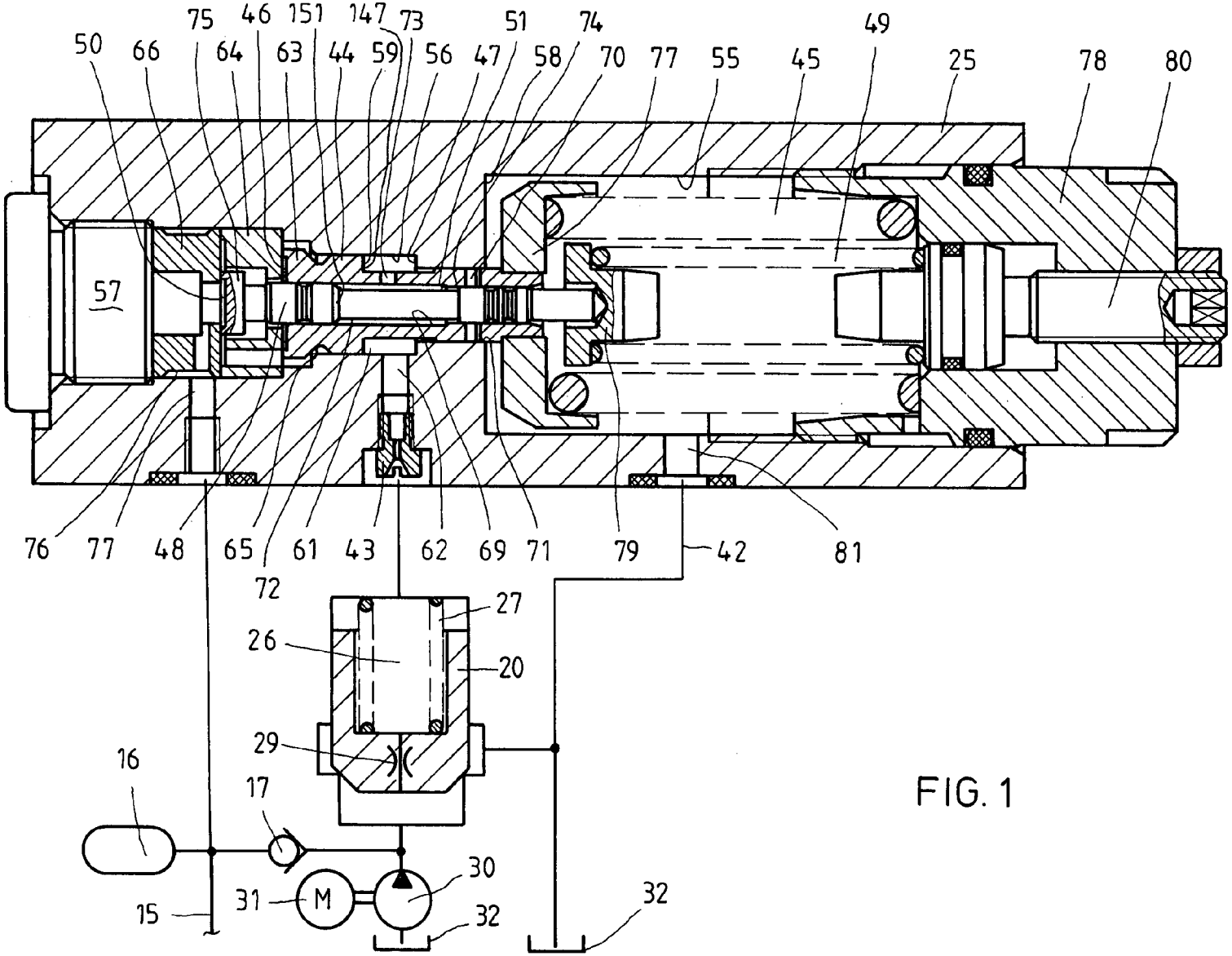
FIG. 1 shows the first exemplary embodiment in a longitudinal section through the pilot valve arrangement.
Figure 3:
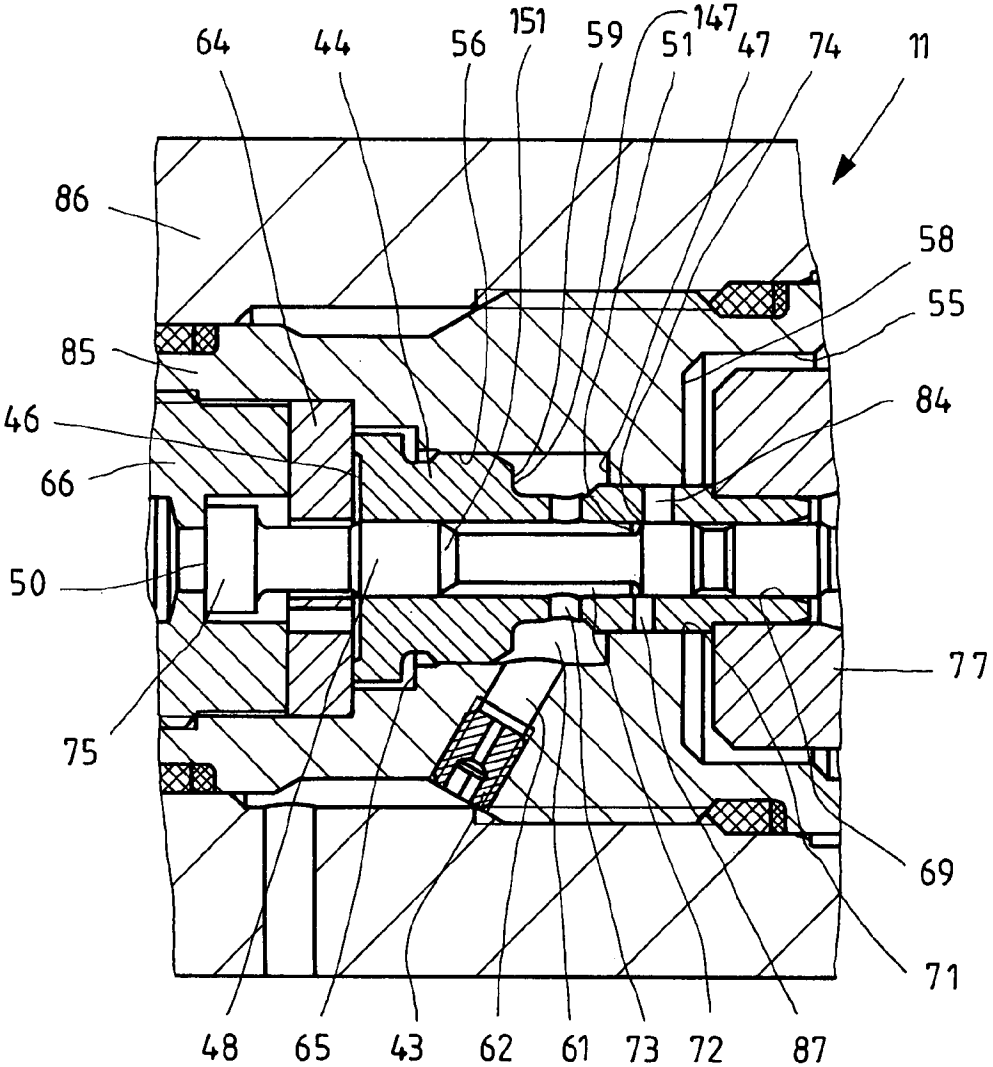
FIG. 3 shows the second exemplary embodiment which differs from the first exemplary embodiment by a further bore in the wall of the first pilot piston, which bore can be influenced by the inner, second pilot piston.

When the main control piston 20 takes up its closed position, as is shown in FIGS. 1 to 3, the hydraulic fluid conveyed by the hydraulic pump 30 flows through the nonreturn valve 17 of the system line 15 and therefore to the hydraulic accumulator 16. If the quantity of pressure medium removed from the system line 15 is less than the quantity flowing into it, the pressure in it and in the hydraulic accumulator 16 rises. The main stage 10 of the pressure shut-off valve shown is controlled in such a manner that the main control piston 20 opens when the pressure in the hydraulic accumulator 16 has reached an upper system limit pressure. The hydraulic pump 30 subsequently conveys the hydraulic fluid, which is sucked up from the tank 32, in a circulating manner via the inlet connection 12, via the throughflow cross section between the seat edge 24 of the housing 22 and the frustoconical surface 23 of the main control piston 20 and via the outlet connection 13 back to the tank 32. Removal of hydraulic fluid from the hydraulic accumulator 16 causes the pressure in the latter to consequently drop. If, finally, the lower system limit pressure which has been set is reached, the main control piston 20 closes the throughflow cross section between the inlet connection 12 and the outlet connection 13, with the result that the hydraulic pump 30 conveys again into the system line 15. During circulating conveying, the pressure in the inlet connection 12 is low and is determined essentially by the force of the helical compression spring 27. The nonreturn valve 17 prevents hydraulic fluid from flowing out of the system line 15 into the inlet connection and via the main control piston 20 and the outlet connection 13 to the tank 32.

The main control piston 20 is controlled by the pilot valve arrangement 11 which, as seen in connection terms, has two pilot valves 40 and 41 which are constructed as 2/2-way directional control valves and which lie in series between the control space 26 on the main control piston 20 and the outlet connection 13. The series connection provides for fluid connection, via both of the pilot valves 40 and 41 when both of the valves are open, between the control space 26 and the outlet connection 13, as shown in FIG. 2. A relief line 42 leads from the pilot valve 40 through the pilot valve housing 25 and the valve housing 22 of the main stage 10 to the outlet connection 13. The control space 26 is connected to the pilot valve 41 via a damping nozzle 43. The first pilot valve 40 has a first pilot piston 44 which is acted upon in the direction of the closed position by a first helical compression spring 45, the prestress of which can be changed in order to set the upper system limit pressure. In the closing direction, the pilot piston 44 is acted upon on a large active surface 46 by the pressure from the accumulator, i.e. by the system pressure. The active surface 46 provides approximately the total force on the piston 44 (as shown in FIG. 1) with other relatively small contributions to the force being provided by undulations/steps in the side surface of the piston. A similar comment applies to an active surface 50 of the piston 48, to be described below. Moreover, with the helical compression spring 45 in the closing direction, the pressure which prevails between the damping nozzle 43 and the pilot valve 41 acts on an active surface 147 (shown also in FIG. 1), the size of which is approximately two thirds of the size of the active surface 46. In the static state of the main control piston 20, this pressure is approximately equal to the pressure in the control space 26.

The pilot valve 41 has a second pilot piston 48 which is acted upon in the closing direction by a second helical compression spring 49, the prestress of which can be changed in order to set the lower system limit pressure. In the closing direction, the pilot piston 48 is acted upon by the system pressure in precisely the same manner as the pilot piston 44, specifically on an active surface 50 (shown also in FIG. 1). With the helical compression spring 49 in the opening direction, the pressure produced between the damping nozzle 43 and the pilot valve 41 again acts on the pilot piston 48. The size of the active surface 151 for this pressure is approximately only 5% of the size of the active surface 50.

The space in which the helical compression springs 45 and 49 are situated is located on the relief line 42.

If, during operation, the main control piston 20 takes up its closed position and the hydraulic fluid conveyed by the hydraulic pump 30 passes via the nonreturn valve 17 to the hydraulic accumulator 16, the pilot valve 40 is in its closed position and the pilot valve 41 is in its open position. The control space 26 is thus blocked off toward the relief line 42. The pressure in it is equal to the pressure in the inlet connection 12. Under the action of this pressure and under the action of the helical compression spring 27 the main control piston 20 maintains its closed position. Virtually the same pressure is produced on the active surfaces 46 and 147 of the pilot valve 40 and on the active surfaces 50 and 151 of the pilot valve 41. The drop in pressure via the nonreturn valve 17 is negligible. The pressure in the hydraulic accumulator 16 rises with the inflow of pressure medium and is finally of such magnitude that the differential surface between the two active surfaces 46 and 147 as the pressure application surface is sufficient for a throughflow cross section to be opened in the pilot valve 40. The pressure arising on the active surface 147 instantly starts to fall, with the result that the pilot valve 40 reliably switches into its open position. Hydraulic fluid can now flow from the control space 26 via the two pilot valves 40 and 41 and the relief line 42 to the tank 32. The main control piston 20 is relieved of pressure on the spring side and opens. The pressure in the inlet connection 12 drops to a low value determined by the prestressing of the helical compression spring 27. The nonreturn valve 17 closes. The hydraulic fluid conveyed by the hydraulic pump 30 consequently flows via the throughflow cross section between the seat edge 24 of the housing 22 and the frustoconical surface of the main control piston 20 back to the tank 32. Only a small quantity of control oil that is determined by the hydraulic resistance of the nozzle 29 and the pressure equivalent to the force of the helical compression spring 27 flows via the pilot valve arrangement to the tank. The pressure by which the pilot valve 40 can be brought into its open position is equal to the upper system limit pressure. Its magnitude is determined by the prestress of the helical compression spring 45 and can be changed by changing this prestress.

While the hydraulic pump 30 is conveying in circulation, the pressure in the hydraulic accumulator 16 gradually decreases by removal of hydraulic fluid for hydraulic consumers. Finally, the pressure is so low that the force which it produces on the active surface 50 of the second pilot valve 41 becomes smaller than the force of the helical compression spring 49. The latter now moves the pilot piston 48 in the closing direction, as a result of which the throughflow cross section is closed by the valve 41 and pressure builds up in the control space 26, into which pressure medium continues to flow via the nozzle 29, and therefore also on the active surfaces 147 and 151 of the pilot valves 40 and 41. The build up of pressure on the active surface 151 of the pilot piston 48 brings about reliable closing of the pilot valve 41. The pressure in the control space 26 is equal to the pressure in the inlet connection 12, with the result that the main control piston 20 closes under the action of the helical compression spring 27 and the pump pressure acting on a surface remainder outside the seat edge 24. The pressure in the inlet connection 12 and in the control space 26 and on the active surfaces 147 and 151 therefore rises to the system pressure which at this instant is identical to the lower system limit pressure. Even before this lower system limit pressure is reached on the active surface 147, the pilot valve 40 also passes into its closed position. The inflow of hydraulic fluid to the hydraulic accumulator 16 causes the system pressure to rise, with, because of the very small active surface 151 in comparison with the active surface 50, a slight rise above the lower system limit pressure being sufficient in order to bring the pilot valve into its open position again. This does not have any effect on the main control piston, since the pilot valve 40 is already in its closed position and prevents relief of the control space 26. Only when the system pressure is again as high as the upper system limit pressure does the pilot valve 40 switch again into its open position.

For reliable and rapid switching of the pilot valve 40 from its open position into its closed position, the active surface 147 is to be at least one third of the size of the active surface 46. If, on the other hand, an upper system limit pressure is set by adjustment of the helical compression spring 45, then, from the ratio of the size of the surface 147 to the size of the surface 46, a pressure is produced which acts on the active surface 46 and against which the helical compression spring 45 could bring the pilot valve 40, when the active surface 147 is relieved, into the closed position even without a switching operation of the pilot valve 41. This pressure is therefore the minimum lower system limit pressure which can be maintained at a given upper system limit pressure. If the ratio between the surface 147 and the surface 46 is, for example, one third, then at a set, upper system pressure of 210 bar, the minimum lower system limit pressure would be 140 bar. If the ratio of the surface 147 to the surface 46 is two thirds, as is preferred, then at a set, upper system limit pressure of 210 bar, the minimum lower system limit pressure is 70 bar. Within this range, the lower system limit pressure can be set by adjustment of the helical compression spring 49. However, the presence of the active surface 51 also provides a limitation for the minimum interval between the upper system limit pressure and the lower system limit pressure.

In a structural respect, the two pilot valves 40 and 41 are integrated one inside the other in a very compact manner, so that they, as is apparent in particular from the section according to FIG. 1, appear as a single valve. Otherwise, in FIG. 1 the components of the main stage, the nonreturn valve 17, a hydraulic accumulator 16 and a hydraulic pump and an electric motor 31 are shown in a similar manner as in FIG. 3 and are provided with the same reference numbers as in FIG. 3. The pilot valve arrangement according to FIG. 1 has a plate-like valve housing 25 in which a blind bore 55 of large volume is made from one side surface. A multiply stepped valve bore 56 which has its largest diameter on the opposite side surface and is closed there by a closure screw 57 opens centrally into the blind bore 55. The valve bore 56 has the smallest diameter directly adjoining the base 58 of the blind bore 55. A stepped hollow piston, as first pilot piston 44, is guided directly in the valve bore 56 and protrudes out of the valve bore 56 into the blind bore 55. An annular space 61 is formed between a stepped surface 59 of the pilot piston 44, which surface is directed away from the closure screw 57, and an axially opposite stepped surface 47 of the valve bore 56 and a channel 62 leading through the valve housing 25 opens radially into it. The annular space 61 is fluidically connected via this channel to the control space 26 on the main control piston, with the damping nozzle 43 being screwed into the channel 62. The pilot piston 44 is acted upon on a resulting active surface, which is identical to the stepped surface 47 of the valve bore 56, in the direction of the closure screw 57 by the pressure prevailing in the annular space 61.

Toward the closure screw 57, the section of the pilot piston 44 having the outside diameter of the stepped surface 59 is adjoined by an outer collar 63 with which the pilot piston 44 can strike, on the one hand, in the direction toward the closure screw 57 against a bushing 64, which is inserted into the bore 59 and is held in a fixed position, and, in the opposite direction, can strike against a further step 65 of the valve bore 56. The path of displacement of the pilot piston 44 is defined by the two axial stops and the axial extent of the outer collar 63. A further bushing 66 is situated between the bushing 64 and the closure screw 57. Said further bushing is pressed by the closure screw 57 against the bushing 64 and the latter is pressed in turn against a step of the valve bore 56.

Centrally, the first pilot piston 44 has a continuous axial bore 69 in which the second pilot piston 48 can be displaced axially. The axial bore 69 is a stepped bore having a bore section of larger diameter which opens outward on that end side of the pilot piston 44 which faces the bushing 64, and having a bore section of smaller diameter which is open toward the blind bore 55 of the housing 25. The cross sections of the two bore sections of the bore 69, which merge into each other in the stepped surface 51 on the pilot piston 44, differ from each other only by approximately 5%. Within the bore section having the smaller diameter, the axial bore 69 is connected to the outside of the pilot piston 44 via a plurality of apertures 70 situated axially at the same height. If, as shown in FIG. 1, the pilot piston 44 bears against the bushing 64, the apertures are covered on the outside by that wall section of the valve bore 56 which is situated between the stepped surface 47 of the valve bore 56 and the base 58 of the blind bore 55. The edge between the base 58 of the blind bore 55 and the valve bore 56 forms a control edge 71 which is fixed on the housing and interacts with the apertures 70. It is passed over by the apertures 70 and hence a throughflow cross section from the apertures 70 into the blind bore 55 is produced when the valve slide 44 is displaced away from the bushing 64 onto the step 65 of the housing 25.

The pilot piston 48 is stepped corresponding to the stepped axial bore 69 and has a guide section in the region of the bore section of smaller diameter and a guide section which is slightly larger in diameter in the bore section of larger diameter. The two guide sections are spaced far apart, with the diameter of the piston section between the two guide sections being reduced once again relative to the diameter of the smaller guide section. As a result and by the step 51, an annular space 72 has been produced radially between the outer pilot piston 44 and the inner pilot piston 48 and axially between the two guide sections thereof. Said annular space is permanently connected via a radial bore 73 in the pilot piston 44 to the annular space 61 and is therefore fluidically connected to the control space 26 on the main control piston 20. The pressure arising in the annular space 72 produces, on an annular surface of the pilot piston 48, which annular surface corresponds to the size of the stepped surface 51 of the pilot piston 44, a force which acts in the direction of the closure screw 57. The outer edge 74 on that end side of the guide section of smaller diameter of the pilot piston 48 which faces the annular space 72 forms a control edge which interacts with the apertures 70 on the pilot piston 44, which is situated, in the switching position of the pilot piston 48 that is shown in FIG. 1, between the stepped surface 51 on the pilot piston 44 and the apertures 70 and is displaced in the other switching position of the pilot piston 48 to such an extent that there is an open, fluidic connection between the annular space 72 and the apertures 70 irrespective of the current switching position of the pilot piston 44.

The second pilot piston 48 protrudes beyond the pilot piston 44 in the direction of the closure screw 57, passes through an inner collar of the bushing 64 and is caught with a head 75 between this inner collar and the bushing 66.

The bushing 66 is provided on the outside with a turned groove 76 which is open toward a bore 77 of the housing 25, said bore being fluidically connected to the system line 15 and therefore to the hydraulic accumulator 16. Those end surfaces of the pilot pistons 44 and 48 which face the closure screw 57 are exposed via radial and axial bores in the bushings 54 and 56 to the pressure arising in the turned groove 76, i.e. to the system pressure. At the pilot pistons, this pressure produces a force which acts upon them such that they move away from the bushings 64 and 66 in the direction into the blind bore 55. The active surface on the pilot piston 44 is identical to an annular surface having an inside diameter, which is identical to the diameter of the larger section of the axial bore 69, and having an outside diameter, which is identical to the outside diameter of the stepped surface 47 of the housing 25. The active surface on the pilot piston 48 is identical to the cross-sectional surface of the larger guide section of this piston.

The two pilot springs 45 and 59 which, like the pilot pistons 44 and 48, are arranged concentrically one inside the other, are situated in the blind bore 55. The outer pilot spring 45 is supported via a spring plate 77 on the first pilot piston 44, loading the latter in the direction of the closure spring 57. On the other hand, it is supported on a setting screw 78 which is screwed into the blind bore 56. The inner pilot spring 49 is supported via a spring plate 78 on the pilot piston 48 protruding beyond the pilot piston 44 and likewise loads said pilot piston in the direction of the closure screw 57. In addition, the pilot spring 49 is supported on a setting screw 80 which is screwed centrally into the setting screw 78 and can be adjusted axially with respect to the setting screw 78 by rotation.

The blind bore 55 is part of the relief channel 42 which also includes a transverse bore 81 in the housing 25, via which bore the relief fluid path leads to the tank 32.

In FIG. 1, the pilot pistons 44 and 48 take up the switching positions illustrated in the connection diagram in FIG. 2. The apertures 70 in the pilot piston 44 are covered on the inside by the pilot piston 48 and on the outside by the housing 25. Pump pressure is produced in the control space 26 on the main control piston 20 and in the annular spaces 61 and 72. Said pump pressure acts upon the pilot piston 48 on a surface with the size of the surface 51 in the same direction as the pilot spring 49. The resulting active surface, on which the pump pressure acts on the pilot piston 44, does not correspond precisely to the size of the active surface 147, but rather is reduced by the surface 51 in comparison with the active surface 147. However, for the sake of simplicity, the corresponding step of the valve bore 56 is provided with the reference number 147 from FIG. 2. This is because the surface 51 is very small in comparison to the surface 147 and can be disregarded for the qualitative understanding of the valve. The pilot pistons 44 and 48 are acted upon in the opposite direction on the active surfaces which have already been explained by the system pressure. If the hydraulic accumulator 16 is charged, this pressure is virtually identical to the pump pressure.

During charging for the first time the pilot piston 48 therefore switches over from the switching position shown in FIG. 1 into the other switching position, if the system pressure is of such a magnitude that it produces a force identical to the force of the pilot spring 49 on a surface, which is as large as the surface 50 reduced by the surface 51. The apertures 70 in the pilot piston 44 are therefore opened on the inside toward the annular space 72 and therefore toward the control space 26 on the main control piston 20. If the system pressure has risen to such an extent that it produces a force which is equal to the force of the pilot spring 45 on a surface 46 of the pilot piston 44 reduced by the active surface 147, the pilot piston 44 is moved from the switching position shown in FIG. 1 in the direction of its second switching position. In this process, the apertures 70 are also opened on the outside, so that hydraulic fluid can flow out of the annular space 61 via the radial bore 73, the annular space 72 and the apertures 70 into the blind bore 55 and from there into the tank 32. The drop in pressure which is caused as a result in the annular space 61 leads to a rapid switching through of the pilot piston 44. Tank pressure now prevails in the annular spaces 61 and 62. The active surface, at which the system pressure acts on the pilot piston 48, is now identical to the cross section of the larger guide section of the pilot piston 48. Correspondingly, the compressive force acting against the pilot spring 49 is also larger than when the hydraulic accumulator 16 is charged for the first time. The pilot piston 48 is therefore brought back into the switching position shown in FIG. 1 at a pressure which is somewhat lower than the pressure which was sufficient during charging of the hydraulic accumulator 16 for the first time in order to bring the pilot piston 48 into the switching position (not shown in FIG. 1) against the pilot spring 49. When the pilot piston 48 is reset when the lower system limit pressure is reached, the apertures 70 in the pilot piston 44 are closed on the inside, with the result that the pressure in the annular spaces 61 and 62 is again identical to the pressure in the inlet of the pump to the main control piston 20. The main control piston 20 therefore closes the connection between the inlet and the tank 32. The pressure in the inlet and in the annular spaces 61 and 72 rises to the system pressure, as a result of which the pilot piston 44 is also brought back again to the switching position shown in FIG. 1. This takes place before the pilot piston 48 is displaced again against the spring 49 into the other switching position, in which the apertures 70 are again opened on the inside.

Figure 4:
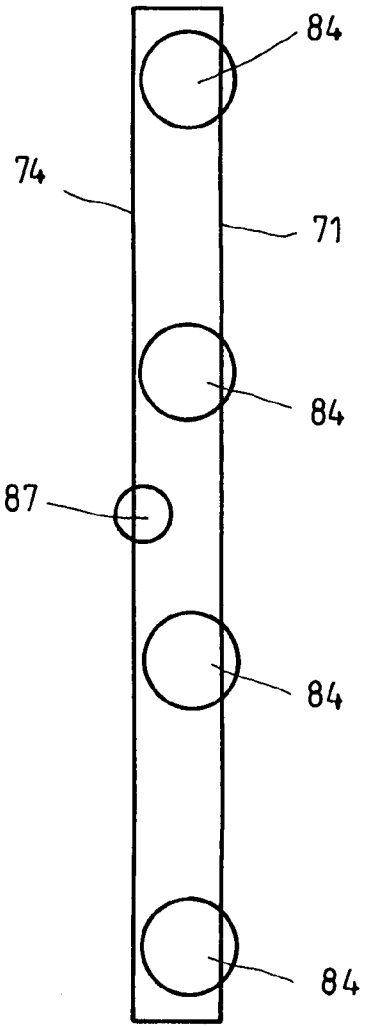
FIG. 4 shows a developed view of the outer pilot piston from FIG. 3 in the region of its bores interacting with a control edge fixed on the housing and with a control edge on the second pilot piston.

The exemplary embodiment according to FIGS. 3 and 4 is largely identical to the exemplary embodiment according to FIG. 1. Accordingly, the same reference numbers as in FIG. 1 are used for the pilot pistons and the various bores and spaces. Also, only the differences will be discussed below. Otherwise, reference is made to the description for FIG. 1.

A first difference resides in the fact that the first pilot piston 44 does not, as in the exemplary embodiment according to FIG. 1, run directly into a plate-like housing, but rather the pilot valve is formed in a cartridge-type construction and has a valve sleeve 85 which accommodates the pistons and springs and which is screwed into a valve plate 86.

Furthermore, the first pilot piston 44 has, in the region of bores 84 which correspond to the apertures 70 according to FIG. 1 and of which four of identical size are distributed uniformly over the circumference in the same radial plane, a further bore 87 which is smaller in diameter and which, as seen in the circumferential direction, is situated centrally between two bores 84, but is offset in the axial direction relative to the bores 84 in the direction of the step in the axial bore 69 of the pilot piston 44. As a result, the control edge 74 still leaves the bore 87 partially open on the inside when the bores 84 have already been covered on the inside. The diameter of the bores 84 in the present case is 1.2 mm and the diameter of the bore 87 is 0.7 mm.

When the upper system limit pressure has been reached and the valve is in the state in which the inlet is connected to the outlet, the two pilot pistons 44 and 48 are displaced to the right as far as a stop. In the switching-back phase after the lower system limit pressure is reached, the second pilot piston 48 first of all migrates to the left and closes the bores 84 on the inside, so that the pressure rises in the annular space 61. In this annular space, a certain pressure which is dependent on the upper system limit pressure and on the lower system limit pressure has to be reached so that the pilot piston 44 switches back. Owing to the leakage which is enlarged in comparison with the first exemplary embodiment because of the bore 87, the second pilot piston 48 continues to remove and also closes the bore 87. The pressure in the annular space 61 rises, with then, if the certain pressure is reached, the first pilot piston 44 moving to the left and the bores 84 also being closed on the outside. The main control piston then closes and the pressure in the accumulator rises.

After a certain rise in the pressure in the accumulator, the second pilot piston 48 switches again into its right end position, in which the head 75 bears against the bushing 64. It has been shown that the bore 87 reduces the sensitivity of the closing operation of the main control piston to tolerances in the size and in the position of the bores 84 in comparison to a solution without a bore 87.

The invention claimed is:

1. A pilot-operated pressure shut-off valve having a main control piston (20) which, when an upper system limit pressure in hydraulic system is reached, connects an inlet (12), via which hydraulic fluid is feedable to a hydraulic system, to an outlet (13) by taking up a first switching position and, when a lower system limit pressure is reached, separates from the outlet (13) by taking up a second switching position, and having a pilot valve arrangement (11) by which fluidic connection of a control space (26) adjacent to the main control piston (20) is changable in order to control the main control piston (20), and which has a valve housing (25, 85), a first pilot piston (44) and a second pilot piston (48) accommodated therein, a first pilot spring (45), against which the first pilot piston (44) is adjustable hydraulically from a first into a second switching position, and a second pilot spring (49), against which the second pilot piston (48) is adjustable hydraulically from a first into a second switching position, and a first setting screw (78) with which the first pilot spring (45) is adjustable in order to set an upper system limit pressure, and a second setting screw (80) with which the second pilot spring (49) is adjustable in order to set a lower system limit pressure, and wherein the two pilot pistons (44, 48), the two pilot springs (45, 49) and the two setting screws (78, 80) are arranged lying concentrically inside one another, with it being possible to adjust the two pilot pistons (44, 48) mechanically completely independently of each other.

2. The pilot-operated pressure shut-off valve as claimed in claim 1, wherein outer pilot piston (44) is situated with an outer collar (63) between two stops (64, 65) fixed on the housing, wherein one stop is formed on a bushing (64) inserted into the valve housing (25, 85), and inner pilot piston (48) penetrates the bushing (64) and is situated with an outer collar (75) between the bushing (64) and a further insert (66) placed in the valve housing (25).

3. The pilot-operated pressure shut-off valve as claimed in claim 1, wherein the first pilot piston (44) is a stepped piston and forms a pressure space (61) upstream of a stepped surface, and wherein the first pilot piston (44) is acted upon on a second active surface (47) by pressure prevailing in the pressure space (61) in a same direction as by the first pilot spring (45), and wherein the first pilot piston (44) is acted upon on a large, first active surface (46) by system pressure counter to direction of action of the first pilot spring (45).

4. The pilot-operated pressure shut-off valve as claimed in claim 3, wherein the second active surface (47) of the first pilot piston (44) is at least one third of the size of the first active surface (46).

5. The pilot-operated pressure shut-off valve as claimed in claim 4, wherein the second active surface (47) of the first pilot piston (44) is approximately two thirds of the size of the first active surface (46).

6. The pilot-operated pressure shut-off valve as claimed in claim 1, wherein the second pilot piston (48) is formed as a stepped piston and is acted upon by pressure on a second active surface (51) in direction of action of the second pilot spring (49) while it is acted upon on a large, first active surface (50) by the system pressure counter to direction of action of the second pilot spring (49).

7. The pilot-operated pressure shut-off valve as claimed in claim 6, wherein the size of the second active surface (51) lies in a region of 5% of the first active surface (50) of the second pilot piston (48).

8. The pilot-operated pressure shut-off valve as claimed in claim 1 wherein the first pilot piston (44) is formed as a hollow piston and the second pilot piston (48) is guided in the first pilot piston (44).

9. The pilot-operated pressure shut-off valve, as claimed in claim 8, wherein by the two pilot pistons (44, 48) of the pilot valve arrangement (11) two throughflow cross sections are controllable which are arranged in series between the control space (26) of the main control piston (20) and a tank connection (13), wherein the first pilot piston (44) is actable upon on a first active surface by system pressure with effect of opening the throughflow cross section which can be controlled by it, and can be acted upon on a second active surface, which is smaller than the first active surface (46), by pressure prevailing in the control space (26) of the main control piston (20) with effect of closing the throughflow cross section, and by the first pilot spring (45), and wherein the second pilot piston (48) is actable upon on an active surface by the system pressure with the effect of opening the throughflow cross section which can be controlled by it, and can be acted upon by the second pilot spring (49) with the effect of closing the throughflow cross section.

10. The pilot-operated pressure shut-off valve as claimed in claim 9, wherein the second pilot piston (48) is actable upon on a second active surface (51), which is substantially smaller than the first active surface, by the pressure prevailing in the control space (26) of the main control piston (20) with effect of closing the throughflow cross section.

11. The pilot-operated pressure shut-off valve as claimed in claim 9, wherein the outer pilot piston (44) has, in its wall, at least one aperture (70, 84) which, in the closed position, is covered on outside by a control edge (71) fixed on the housing, and, in open position of the outer pilot piston (44), is open toward a relief space (55), wherein the inner pilot piston (48) has a control edge (74) by which, in closed position of the inner pilot piston (48), the apertures (70, 84) in the outer pilot piston (44) are covered on inside irrespective of position thereof while, in open position of the inner pilot piston (48), the apertures (70, 84) of the outer pilot piston (44) are open on the inside irrespective of position thereof toward an annular space (72) which is formed between the two pilot pistons (44, 48) and is fluidically connected to the control space (26) on the main control piston (20) via a further aperture (73) in the outer pilot piston (44).

12. The pilot-operated pressure shut-off valve as claimed in claim 11, wherein an outer annular space (61) is formed axially between a step of the first pilot piston (44) and a step (47) of the valve housing (25), into which a channel (62) leading through-the valve housing (25) to the control space (26) on the main control piston (20) opens, wherein an inner annular space (72) is formed between the first and the second pilot pistons (44, 48) by an annular recess on the second pilot piston (48), said annular space being fluidically connected to the outer annular space (61) via at least one radial bore (73) in the outer pilot piston (44), and wherein an aperture (70, 85) in the first pilot piston (44), which aperture is to open on the outside toward the relief space (55), can be passed over by a control edge (74) of the second pilot piston (48), said control edge bounding the annular recess.

13. The pilot-operated pressure shut-off valve as claimed in claim 12, wherein the second pilot piston (48) has a certain diameter at control edge (74) and has a slightly larger diameter in comparison on an other side of the annular recess.

14. The pilot-operated pressure shut-off valve as claimed in claim 12, wherein the first pilot piston (44) has, in its wall, at least one further aperture (87) which is covered on outside in every position of the first pilot piston (44) and opening cross section of which into the inner annular space (72) is influencable by position of the control edge (74) of the second pilot piston (48) relative to the first pilot piston (44).

15. The pilot-operated pressure shut-off valve as claimed in claim 14, wherein the apertures (84) which are to open toward the relief space (55) are first bores which are identical in size, lie in the same radial plane and are arranged at same angular spacings from one another, wherein the further aperture (87) in the first pilot piston (44) is a second bore, the diameter of which is smaller than the diameter of the first bores (84) and which, in direction away from the relief space (55), protrudes above the first bores (84) by at most half the diameter.

16. A pilot valve arrangement for a pilot-operated pressure shut-off valve, the pilot valve arrangement (11) being in fluidio connection with a control space (26) adjacent to a main control piston (20) of the shut-off valve in order to control the main control piston (20), the pilot valve arrangement comprising a valve housing (25. 85), a first pilot piston (44) and a second pilot piston (48) accommodated therein, a first pilot spring (45), against which the first pilot piston (44) is adjustable hydraulically from a first into a second switching position, and a second pilot spring (49), against which the second pilot piston (48) is adjustable hydraulically from a first into a second switching position, and a first setting screw (78) with which the first pilot spring (45) is adjustable in order to set an utter system limit pressure, and a second setting screw (80) with which the second pilot spring (49) is adjustable in order to set a lower system limit pressure, and wherein the two pilot pistons (44, 48), the two pilot springs (45, 49) and the two setting screws (78, 80) are arranged lying concentrically inside one another, with it being possible to adjust the two pilot pistons (44, 48) mechanically completely independently of each other.

* * * * *